US008963740B2

(12) United States Patent
Koukoumidis et al.

(10) Patent No.: US 8,963,740 B2
(45) Date of Patent: Feb. 24, 2015

(54) CROWD-SOURCED PARKING ADVISORY

(71) Applicant: Microsoft Corporation, Redmond, WA (US)

(72) Inventors: Emmanouil Koukoumidis, Bellevue, WA (US); Brian Beckman, Newcastle, WA (US); Norm Bryar, Sammamish, WA (US); Elad Gerson, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 14 days.

(21) Appl. No.: 13/826,575

(22) Filed: Mar. 14, 2013

(65) Prior Publication Data

US 2014/0266800 A1 Sep. 18, 2014

(51) Int. Cl.
*G08G 1/14* (2006.01)

(52) U.S. Cl.
CPC ..... *G08G 1/141* (2013.01)
USPC ..... 340/932.2; 340/905; 340/426.2

(58) Field of Classification Search
USPC ..... 340/932.2, 937, 905, 901, 988, 995.1, 340/995.24, 426.2
See application file for complete search history.

(56) References Cited

U.S. PATENT DOCUMENTS

| | | | | |
|---|---|---|---|---|
| 5,877,704 | A * | 3/1999 | Yoshida | 340/932.2 |
| 6,081,206 | A * | 6/2000 | Kielland | 340/937 |
| 6,161,497 | A * | 12/2000 | Sallee | 116/28 R |
| 7,538,690 | B1 | 5/2009 | Kaplan et al. | |
| 7,825,827 | B2 | 11/2010 | Jang et al. | |
| 7,893,847 | B2 | 2/2011 | Shanbhag et al. | |
| 2009/0204319 | A1 * | 8/2009 | Shanbhag et al. | 701/201 |
| 2010/0318290 | A1 | 12/2010 | Kaplan et al. | |
| 2011/0140922 | A1 | 6/2011 | Levy et al. | |
| 2012/0056758 | A1 * | 3/2012 | Kuhlman et al. | 340/932.2 |
| 2012/0218122 | A1 | 8/2012 | Bogaard | |
| 2012/0299749 | A1 | 11/2012 | Xiao et al. | |

* cited by examiner

*Primary Examiner* — Daniel Previl
(74) *Attorney, Agent, or Firm* — Steve Spellman; Doug Barker; Micky Minhas

(57) ABSTRACT

Architecture that employs crowd-sourced parking-related information to compute the probability of finding parking spots at specific road segments, parking lots, and/or in larger geographic areas. The crowd-sourced parking-related information can be obtained from geolocation (geographical location) traces. This approach utilizes a method of mining location traces to compute the probability of finding parking spots at specific road segments, parking lots, and/or in larger geographic areas. The location traces can be mined to classify parking areas as public, private, and semi-private (e.g., only for company employees in certain area that also include public parking areas). The location traces can be mined to infer the times and dates (e.g., hours of the day and the days of the week) during which a vehicle is allowed to park at a given location.

20 Claims, 7 Drawing Sheets

CROWD-SOURCED PARKING ADVISORY

BACKGROUND

In a world where time is a becoming an even more precious commodity, the search for a parking spot can be a major concern and stress factor for drivers. At the same time, the search for a parking spot can significantly impact traffic conditions. According to a recent study, vehicles circling city blocks in search for a parking spot increase traffic in big cities by one account, as much as thirty percent. In other words, this stressful process feeds on itself by worsening traffic conditions when looking for a place to park.

Several systems have been built that detect the availability of parking spots using suitable sensors mounted on the road surface. However, this approach requires expensive installation and maintenance costs. A proposed research system uses ultrasonic sensors mounted on the side of vehicles to detect free spots. However, such installations are expensive, do not exist in any commercial vehicle setting to date, and are not likely to be deployed in the near future.

SUMMARY

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

The disclosed architecture guides drivers to parking locations where the drivers are likely to find parking spots. To achieve this, the architecture utilizes crowd-sourcing parking availability statistics from geolocation (e.g., geographical coordinate computing systems such as global positioning system (GPS)) traces and other sources of information such as sensors (e.g., an inertial sensor such as an accelerometer, gyroscope, etc.) that may be available on the user's mobile device (e.g. smartphone) or onboard vehicle device.

Generally, the architecture employs crowd-sourced parking-related information to compute the probability of finding parking spots at specific road segments, parking lots, and/or in larger geographic areas. The crowd-sourced parking-related information can be obtained from geolocation (geographical location) traces.

This approach utilizes a method of mining location traces to compute the probability of finding parking spots at specific road segments, parking lots, and/or in larger geographic areas. The location traces can be mined to classify parking areas as public, private, and semi-private (e.g., only for company employees in certain area that also include public parking areas). The location traces can be mined to infer the times and dates (e.g., hours of the day and the days of the week) during which a vehicle is allowed to park at a given location.

The location traces can be mined to infer the maximum allowed time that a vehicle is allowed to park at a given location (e.g., on the street), at any given time (e.g., after 10 AM), for a time span (e.g., two hours), day of the week (e.g., weekends), etc. The information collected can be merged with information from other sources such as municipality data, parking garage websites, forums and blog posts for user comments on parking availability, weather websites, event websites, social networks (e.g., user confirmation data such as RSVP data), check-in websites, construction notification websites and other abnormalities that will impact parking conditions (e.g., public transportation inoperable, worker strikes, etc.). The architecture automatically detects when a user is looking for a parking spot such as detecting that the user is circling city or residential blocks, is approaching a geographical area that includes a destination, has arrived in a geographical area that includes a destination, etc., and then sends a parking availability advisory.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
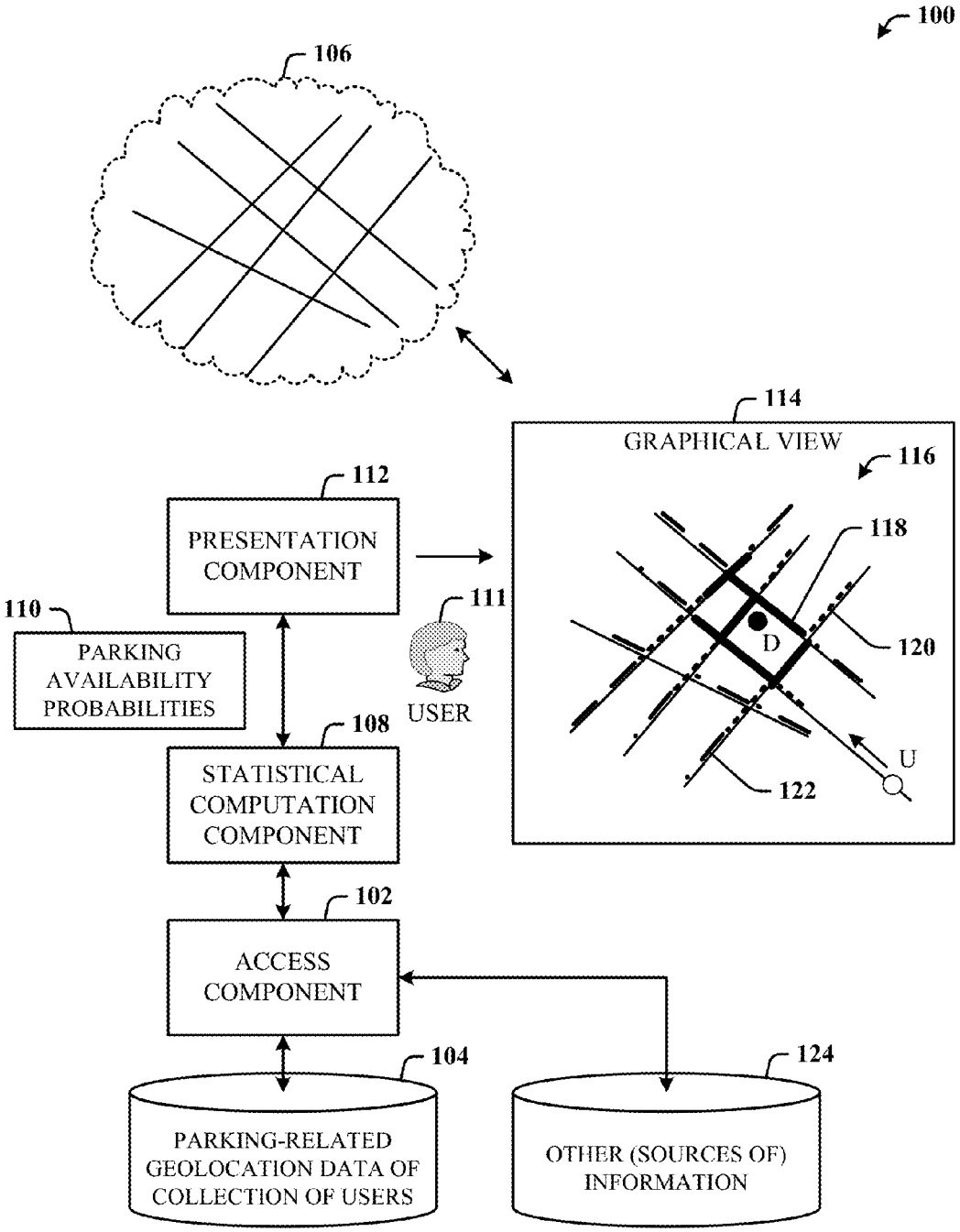
FIG. 1 illustrates a system in accordance with the disclosed architecture.

The disclosed advisory architecture utilizes crowd-sourced data such as geolocation data to compute the difficulty (probability or likelihood) of finding parking spots (e.g., free) at given geographical locations, and then present the information to a user in a graphical view. Additionally, the finding can be further based on other information such as associated with during specific hours of the day and days of the week. This knowledge is then fed back to users as the users are approaching their destination and searching for a parking place.

The difficulty of finding a parking spot at given location (and at a given time of the day and day of the week) can be estimated by mining geolocation data (e.g., traces—multiple data points).

Crowd-sourcing obtains services, ideas, and/or content by soliciting or capturing data from a collection of people, and particularly people from an online community, rather than from traditional employees or suppliers, although the employees and/or suppliers can be part of the collection. This process can occur both online and offline. Crowd-sourcing is different from ordinary outsourcing, in that crowd sourcing is an online, distributed problem-solving and production model.

Crowd-sourced data includes data such as from an inertial navigation system such as motion sensors (e.g., accelerometers) and rotation sensors (e.g., gyroscopes) to continuously calculate via directional information and potentially position, orientation, and speed of a moving object (e.g., user, vehicle, etc.) without the need for external references.

Inertial sensors such as the accelerometer can be used to measure the instantaneous acceleration of the device, and thus, the accelerometer is commonly used to detect the mode of transport (e.g., walking, driving, riding a bus, etc.) of the user and oftentimes used in combination with localization data (e.g., GPS coordinates). The gyroscope can be used to detect the direction (or heading) that the device is facing, but not the direction that the device is moving. The detection of the direction and speed of movement comes normally from localization sensors (e.g., GPS). Inertial sensors can be used to estimate device position through a process called dead reckoning. In other words, crowd-sourced data includes data such as from localization devices (e.g., GPS, WiFi, cell towers, etc.) and inertial sensors (e.g., accelerometer, gyroscope, etc.) to calculate position, orientation, and speed, and detect the user's mode of transportation (e.g., walking, driving, riding the bus, etc.).

In the context of parking, the disclosed architecture assesses the difficulty (the probability) of finding a parking place in a given geographical area using these data sources by processing already commonplace geolocation data (e.g., GPS-global positioning system) and inertial sensors (e.g., accelerometer) of user devises such as smartphones, etc.).

The architecture guides drivers to locations where they are likely to find parking spaces using crowd-sourcing of parking availability statistics from geolocation traces. As described, other data can be utilized such as from inertial sensors (e.g., accelerometer) that may be available on a user device (e.g., smartphone, computer, vehicle subsystem, etc.) or onboard vehicle devices.

More specifically, the disclosed architecture discloses methods for crowd-sourcing parking related information from location traces and other sources of information. This includes, but is not limited to, a method for mining location traces to assess the difficulty of finding parking spots at specific road segments, parking lot or broader geographic areas, a method for mining location traces to classify parking areas as public, private, semi-private (e.g., only for company employees), a method for mining location traces to infer the hours of the day and the days of the week during which a vehicle is allowed to park at a given location, a method for mining location traces to infer the maximum allowed time that a vehicle is allowed to park at a given location at given day of the week/month and hour of the day, a method for conflating (e.g., merging) this information with information from other sources (e.g., municipality data, parking garage websites, forums, blog posts that include user comments on parking availability, (online) information about events (e.g., from social networks, events, check-in/check-out websites, etc.) and other abnormalities (e.g., public transportation out of operation, strikes, construction, etc.) that may influence the regular parking conditions, and, a method for automatically detecting when the user is looking for a parking spot (e.g., circling blocks, arriving at destination, etc.) and pushing a parking availability advisory. Moreover, based on the user proximity to the desired destination and/or parking areas of the geographical area, the frequency of updating the graphical view can be increased.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

FIG. 1 illustrates a system 100 in accordance with the disclosed architecture. The system 100 can include an access component 102 that accesses parking-related geolocation data of a collection of users 104 that have parked or searched for parking in a geographical area 106. A statistical computation component 108 computes parking availability probabilities 110 for parking in the geographical area 106 based on the parking-related geolocation data of the collection of users 104. A presentation component 112 presents a representation of the parking availability probabilities 110 to a user 111 searching for a parking space in the geographical area 106.

The presentation can be accomplished by one or more media (e.g., video, image, text, audio, etc.), such as graphical, as in a graphical view 114, and/or audibly as computer-generated audio. The presentation can be performed via a user device such as a smartphone, a tablet computing device, a personal computer, and/or a vehicle presentation system (display, audio system, etc.).

The presentation component 112 presents the parking availability probabilities 110 in the graphical view 114 as different corresponding colors (represented as different line characteristics) on a street map 116 of the geographical area 106. For example, a low parking availability probability value (for a low likelihood of finding parking) can be represented as a red color (depicted as thick black lines 118), a medium parking availability probability value (for a medium likelihood of finding parking) can be represented as a yellow color (depicted as dotted black lines 120), and a high parking availability probability value (for a high likelihood of finding parking) can be represented as a green color (depicted as dashed black lines 122).

The user location can be designated in the graphical view as a circle annotated with the letter "U" and the user destination can be designated as a black dot annotated with the letter "D". Depending on the time of day, such as noon on a weekday, the number of vehicles occupying parking near the destination D is likely to be very high. Thus, the likelihood of finding parking is very low, and hence, graphically presented as a red color.

The presentation component 112 can also automatically update the parking availability probabilities 110 in the graphical view 114 as the user 111 searches (drives around or is driven around) for the parking space in the geographical area 106. Thus, the coloring in the graphical view 114 can change as the geolocation data of the user 111 indicates the user is approaching the destination D, as the time changes, and other conditions occur (e.g., weather, construction, accidents, etc.) that effect parking availability, for example.

Although not shown here, there typically are parking facilities (e.g., lots, garages, etc.) along the streets and avenues in the street map 116. Thus, graphical emphasis can also be applied to these facilities to similarly give to the user 111 an indication of parking availability for these facilities. For example, if parking information, as part of other (sources of) information 124, for a given parking garage is made accessible to the access component 102, this parking information can be processed to determine the graphical emphasis to apply to the facility as presented in the graphical view 114. For example, if the facility is nearly empty, the facility color can be green, whereas if the facility is full, the facility color can be red. If the facility is closed, the facility can be represented as red in color, or not shown at all in the view 114.

In other words, the presentation component 112 applies graphical emphasis to the graphical view 114 of the street map 116 of the geographical area 106. The graphical emphasis is applied to parking along streets and avenues of the map 116. Additionally, the graphical emphasis can be as various colors associated with differing parking availability probabilities 110 of the parking along the streets and avenues.

The statistical computation component 108 computes the parking availability probabilities 110 for parking in the geographical area 106 based on the parking-related geolocation data of a collection of users 104 and a time during which the user 111 is searching for the parking space. The computes probabilities will likely change based on the time of day, and day of the week. The statistical computation component 108 can also classify the parking in the geographical area 106 according to degrees of public and private access. That is, parking along a street or in a parking facility can be classified as public, private or semi-private. Moreover, this classification can change based on the time of day. For example, parking in a parking garage of a business can be a combination of public parking (e.g., for visitors, customers, etc.) and private (e.g., for employees and business invitees). This classification may change on weekends, for example, such that the private parking spaces are released for use by the public.

Figure 2:
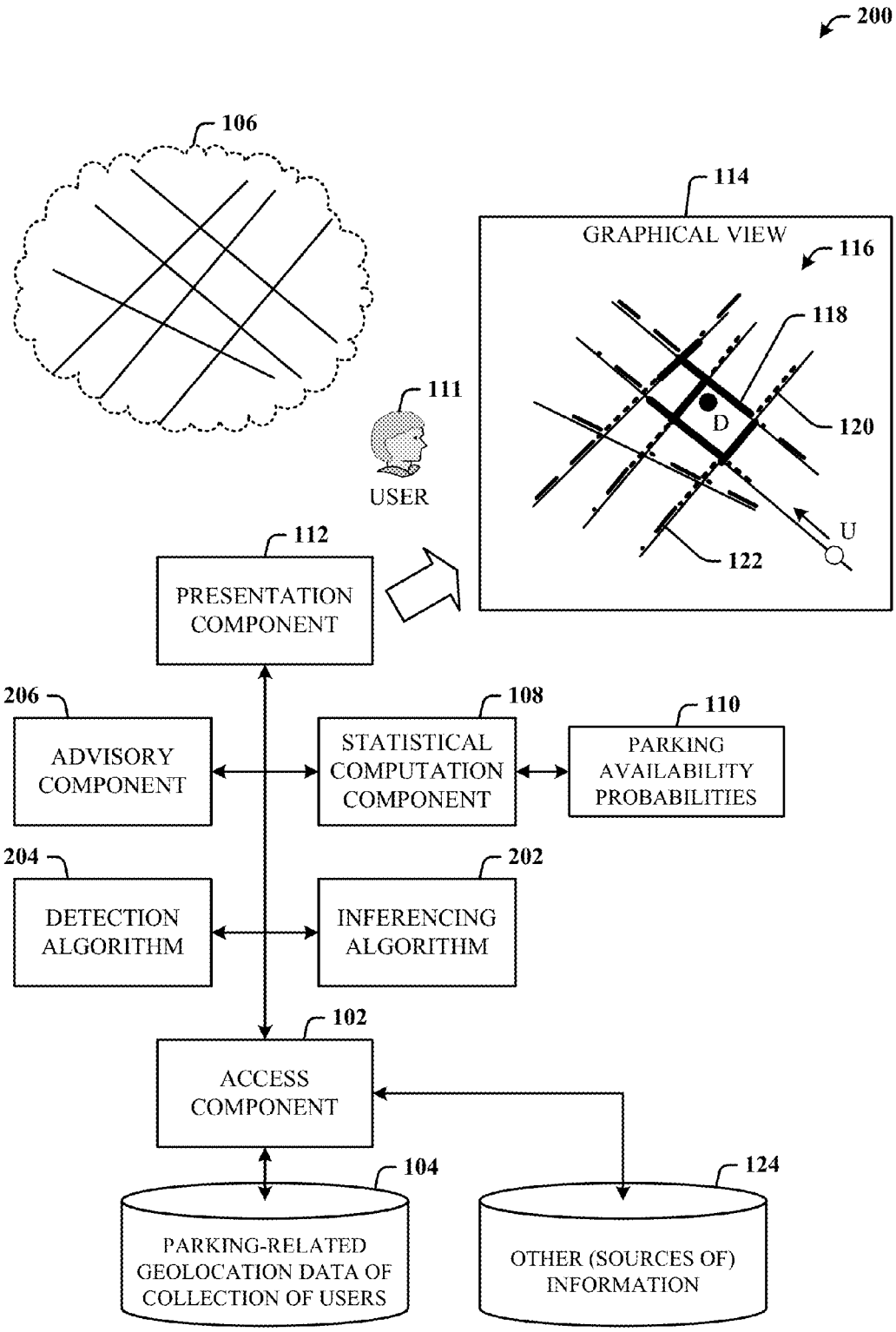
FIG. 2 illustrates an alternative system that includes additional capabilities of inferencing, parking search detection, and parking advisory issuance.

FIG. 2 illustrates an alternative system 200 that includes additional capabilities of inferencing, parking search detection, and parking advisory issuance. System 200 includes the entities, capabilities, and components of the system 100 of FIG. 1. The system 200 can further comprise an inferencing algorithm 202 that infers time-related restrictions on the parking space based on the parking-related geolocation data of the collection of users 104 and other (sources of) information 124.

This inference can be based on how much time the collection of users remain parked in a given spot, area, facility, etc., and this can be processed relative to other temporal information dimensions such as hour, day, week, month, etc. This time duration (span) can be computed (e.g., as an average) based on time-stamped geolocation information of users who park in the space. For example, if it is determined by geolocation data that users who parked in a given space routinely leave within two hours, it can be inferred that the parking space has a two-hour time restriction attached to it. Additionally, the start time for such a parking duration can also be captured. For example, it may be the case that parking for a given spot is restricted to two hours on a weekday, but is free parking all day on the weekend.

A detection algorithm 204 automatically detects the user 111 is searching for the parking space in the geographical area 106 based on geolocation data and inertial data of the user 111. The geolocation data of the user can be obtained via a user device (e.g., smartphone), triangulation of cellular service, a user vehicle GPS system, inertial sensor components such as accelerometer and/or gyroscope of the user device and/or vehicle, Wi-Fi connectivity/hopping along a route the user may be driving, and so on.

The system 200 can further comprise an advisory component 206 that sends an advisory (e.g., message) to the user 111 via the presentation component 112. The advisory notifies the user 111 of the parking availability in the geographical area 106 according to the parking availability probabilities 110. The advisory can be a service-generated text message from a web service or cloud service, for example. The advisory can also take the form of an audio alert, message, and the like. Receipt of the advisory can be processed to automatically enable the user device presentation system and/or vehicle presentation system to present the graphical view 114.

The systems 100 and 200 can each also incorporate a privacy component (not shown) that enables the user 111 to opt-in or opt-out of capturing user geolocation data and inertial sensor data, for example, for this specific purpose.

Figure 3:
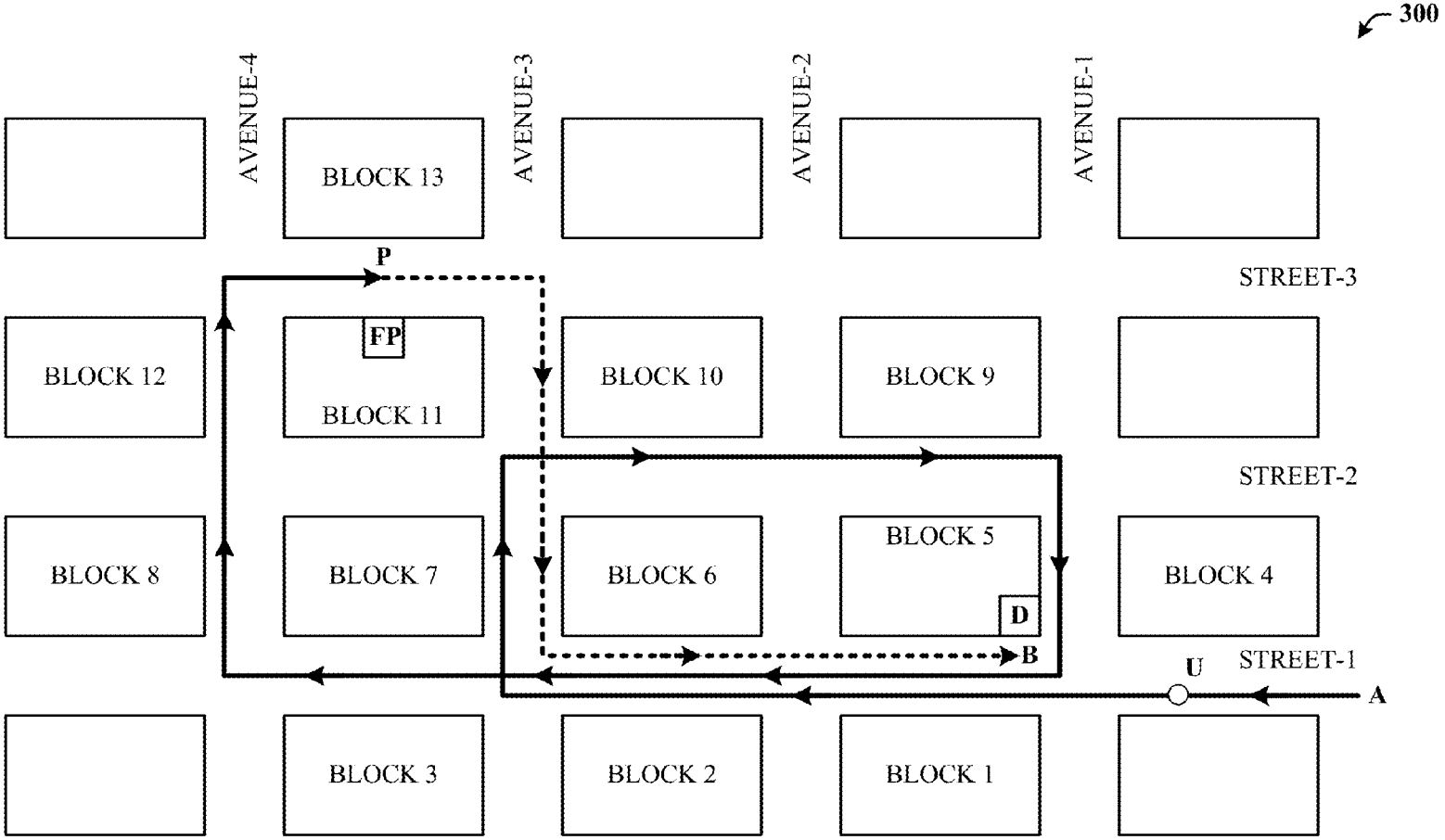
FIG. 3 illustrates a sample city street and block layout to describe detection and computation techniques in accordance with the disclosed architecture.

FIG. 3 illustrates a sample city street and block layout 300 to describe detection and computation techniques in accordance with the disclosed architecture. In this scenario, the layout 300 shows thirteen blocks that the user U may drive (designated by a solid arrowed line) in search of a parking place. The user U enters the layout 300 on Street-1 from point A heading to destination D, and ideally, hopes to find a parking place close to destination D. However, the user U, unable to readily find a parking place near destination D on Street-1, begins a wider search by circling the closest blocks—Block 5 and Block 6. However, user U does not find a parking place on Street-1, Avenue-3, Street-2, or Avenue-1.

Driving past the destination D again, the user then widens the search by going farther (extends the radius from) from the destination D. This widened search tracks from destination D on Street-1, passed Block 5 and Block 6, and along Block 7. Not finding parking along Street-1 of Block 7, the user U makes a right turn onto Avenue-4 searching for parking on Avenue-4 along Block 7, Block 8, Block 11, and Block 12. Not finding parking on Avenue-4, the user again makes a right turn on Street-3, hoping to find parking along Block 11. The user U then finds free parking (FP) at point P. The free parking can be in a parking facility such as a parking garage, parking lot, or simply the parking space FP on Street-3. After parking, the user U then changes the mode of transportation from riding to walking (designated by the dotted arrowed line). The user U then walks down Avenue-3 along Block 10 and Block 6, turns left to continue walking on Street-1 along Block 6 and Block 5 to the destination D at point B.

Given that user U is carrying a smartphone, and comprises GPS capability, Wi-Fi connectivity capability, and one or more inertial sensors (e.g., accelerometer, gyroscope), the detection algorithm 204 can detect not only the turns made in the layout 300, but also speed, starts, stops, and so on. For example, continually making turns back to the direction of the destination D, whether the physical data for the address of destination D is known or unknown, the disclosed architecture can infer that the user U is searching for a parking place, by vehicle driving. If the user U has entered address information for the destination D, this provides more affirmative data that the user may be searching for parking.

The destination D location for the user may be known by analyzing (offline) user data for the purpose of calculating parking statistics, the knowledge obtained in any one or more of the following ways: the user input the destination information, past user data is analyzed (e.g., the user has been going to this destination frequently in the past and at about the same time), and, by analyzing user data and determining that the user dwelled at destination D for a significant amount of time. This indicates that destination D was the user's intended destination when trying to find parking.

Additionally, detecting that the user U made ever-widening travel from the destination D, and then switching from a faster speed (associated with driving) to a slower speed (associated with walking), it can be inferred (detected) that the user U did find parking at point P. The fact that the user parked (the user mode of transport changed from driving to walking) can normally be detected not only based on user speed (via localization devices like GPS) but (more commonly) with the help of inertial sensors (e.g., accelerometer) as walking has a distinctive motion pattern versus motion normally associated with driving, etc.

In the least, from this pattern of movement, it can be inferred with some relatively high probability that the user did not find parking along Block 1, Block 2, Block 3, Block 4, Block 5, Block 6, Block 7, Block 10, and Block 9 on either of Street-1 or Street-2, did not find parking along Block 7 on Street-1, did not find parking on Block 7, Block 8, Block 11, and Block 12, on Avenue-4, or part of Block 11 on Street-3. Additional inferences can be made based on other information about the streets and avenues such as which are one-ways and which are not.

At the same time, by looking at user attributes (as may be determined from other information such as online sources and/or user profiles/preferences) such as common attributes of employees of the same company, a different user each time, etc., the parking can be classified as some degree of public and private parking. Additionally, as previously described, the maximum time span (duration) for which vehicles are allowed to park in this space as a function of the different hours of the day and days of the week can indicate public or private.

Continuing with the example, when the user U returns to the free parking place, and drives away, this change in movement (speed) can be detected and processed to compute the parking time duration for that parking place.

Figure 4:
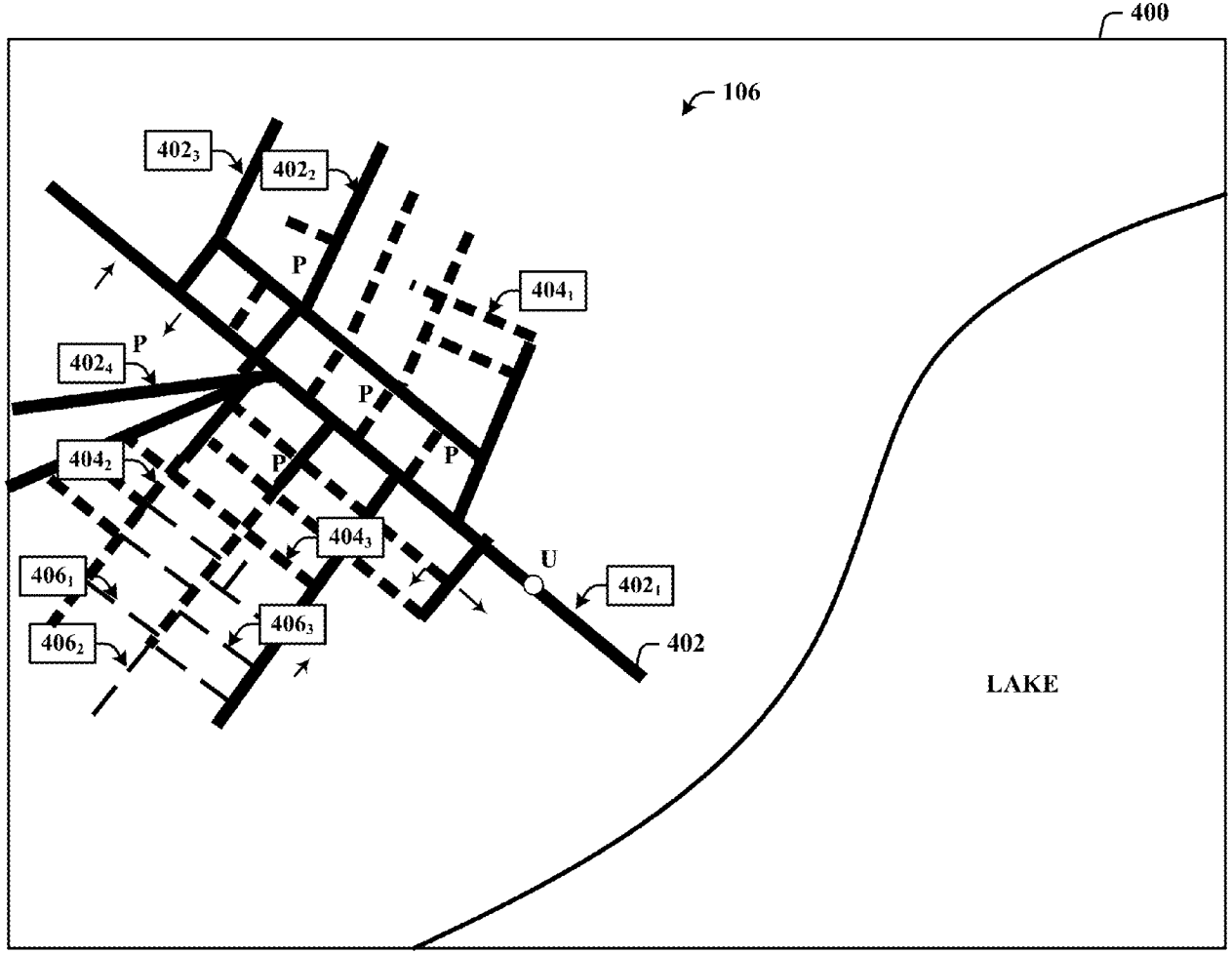
FIG. 4 illustrates an exemplary graphical view for crowd-sourced advisory in accordance with the disclosed architecture.

FIG. 4 illustrates an exemplary graphical view 400 for crowd-sourced advisory in accordance with the disclosed architecture. In this view 400, a city street map view is presented with street, avenue, and route annotations (names, numbers, etc.), building markings (e.g., names), and parking facility markings "P", to name just a few, and which are commonly found on street maps. However, the disclosed architecture overlays the graphical emphases (e.g., color bars) to the geographical area 106 in which the user is heading/driving to indicate the varying probabilities of finding parking in corresponding areas. The user U is graphically represented as a circle moving (or other object such as a car) down a major route 402 in the direction of a user destination (unknown).

In another implementation, graphical emphasis such as a "tinting" effect or a "misting" effect can be presented in the display (view) to indicate an overall or average probability in an area. For example, an area on the map showing numerous thick red streets (low-probability of parking) can have applied a red mist or tint or fog effect; and an area in the map view associated with a high probability of available parking can be represented with a green mist. The tinting (fog and/or misting effects) can be applied in combination with the coloring of street/avenue lines or instead of street/avenue coloring, as enabled by user option, to reduce the clutter of the display.

A prior graphical view prior to a subsequent graphical view can show regions of high parking availability probability in green tint (emphasis) (here, as dashed lines of a series $\mathbf{406}_x$ label, where x is an integer) without street-line coloring if the user is a predefined distance from the routes (streets and/or avenues). This indicates the notion of "drive this way to have a better chance" and to turn on street coloring, for greater precision in indicating the probabilities of parking, for areas near the user. "Far" and "near", in this context can be measured in time (e.g., seconds of drive time), distance (e.g., blocks, miles, etc.), and/or some other relevant measure.

Although the destination may be unknown to the architecture, the architecture computes that during the time of day and for the parking in the area of downtown, the crowd-sourced data indicates that the graphically emphasized areas reflect the historical data captured from the collection of users. Although not depicted in color, a low probability parking route $\mathbf{402}_1$ can be shown in a first color (e.g., red, although depicted here as a thick solid lines of series $\mathbf{402}_x$ label) to indicate that there is a low probability of finding parking along routes so colored, such as routes $\mathbf{402}_2$, $\mathbf{402}_3$, and $\mathbf{402}_4$, for example.

The user will perceive the view 400 and choose to either continue looking for parking along the low probability routes $\mathbf{402}_x$ (e.g., $\mathbf{402}_2$, $\mathbf{402}_3$, etc.), or choose to drive along next higher probability routes (streets/avenues) labeled as series $\mathbf{404}_x$ (e.g., $\mathbf{404}_1$, $\mathbf{404}_2$, $\mathbf{404}_3$, etc., depicted here as dotted lines) having a second graphical emphasis (e.g., yellow). Still further, the user will perceive the view 400 and may choose to drive along the highest parking availability probability routes (streets/avenues) of the series $\mathbf{406}_x$ (e.g., $\mathbf{406}_1$, $\mathbf{406}_2$, $\mathbf{406}_3$, etc.) having a third graphical emphasis (e.g., green).

Oftentimes, vehicle dashboard navigation devices (computing localization (geo-coordinate data) and using software-based route planning) suggest routes to the user to assist the user in finding a destination taking an optimum route. The disclosed architecture can be design to operate in combination with these route planning modules that can detect that the user is nearing a destination, and then route the user to a most likely parking area/space. By combining parking advisory with route planning, the route planning navigation device can enter a mode that indicates to the user that at this time the user is still within a configured walking distance of the destination. The device then switches to the advisory mode and begins to search for parking. The combined system can suggest a route to the user that will take the user through the "green" or high probability street/avenue/parking area so that the probability of finding parking (free or otherwise) in any of these streets/avenues/parking areas is high. It is desired to route the user through five yellow routes on the way to one green route, rather than four red routes on the way to the one green route. Moreover, the advisory to the user can be via computer-generated voice so that the user can maintain eye contact with the road while driving.

The other information 124 can also include user profiles and user preferences that serve to refine or filter capabilities of the disclosed architecture. For example, a user preference can be to consider parking no farther than a predefined distance (e.g., six blocks, one mile, etc.) from the desired destination, in response to which the disclosed architecture adapts the graphical view accordingly to only present parking areas within this distance from the destination.

Given that user devices include many sensor subsystems in addition to inertial sensors and geolocation sensing subsystems, other subsystems can supplement these, such as, imaging to capture and process images that may serve as confirmation of the user location. Another is the audio system where a microphone can capture audio signals that may indicate the user location, such as from speech recognition of the user speaking the user location, audio analysis of sounds such as a train moving passed, construction sounds, other vehicle traffic sounds, and so on.

The other information 124 can be obtained from public camera systems such as at street corners, on buildings, in parking garages, etc., to assist in finding and computing parking availability probabilities for the advisory architecture.

The other information 124 can be obtained from publicly available online sources such as weather website, construction websites, municipality websites that indicate traffic conditions, road conditions, and social websites that through social media user chatter (text and interchanges) may include text about travel/driving conditions in a geographical area.

The other information 124 can further include check-in and check-out services that may be provided by businesses that capture when a user enters a business such as a restaurant or event, and also captures when the user leaves. This information may be computed as part of the parking availability probabilities for the geographical area.

The other information 124 can include Wi-Fi hotspots that may detect user device connectivity as the user moves passed, either driving or walking. Using this technique, the speed and heading may also be computed.

The other information 124 can also include knowledge of the mode of user transportation, whether walking, driving in a personal vehicle, riding public transportation, running, and so on. For example, if the user is riding a motorcycle, which can fit into smaller parking places, the advisory architecture can be made to detect or receive this information and adjust the advisory accordingly.

As indicated herein, the other information 124 can further include data about the direction of traffic flow on streets and avenues, such as for one-way traffic and two-way traffic. Moreover, one-way traffic may be switched to two-way traffic, and vice versa, based on the time of day, day of the week, and based on events being held, and so on.

A value-added implementation of the advisory architecture facilitates providing paid subscribers with higher-reliability parking availability information (graphical views) than non-subscribers. Advertising can be adjusted as well for the level of subscription. In another example, and based on a robust advisory implementation, specific parking places can be detected such that a paid subscriber can be directed to a specific parking place rather than the more general areas, and the non-subscriber simply receive the more general area view. In such an implementation, a subscriber leaving a parking space can send notification to the system of the imminent availability of the parking space, in which case the architecture directs another paid subscriber looking for parking directly to the parking space.

The other information 124 can include face-recognition data as captured and potentially provided by businesses such that parking availability probabilities can be more precise. The other information 124 can also include other sensor data such as from RFID (radio frequency identification) where user/vehicles include passive RFID circuits, the RFID readers can detect that a user has passed within proximity of a reader at a specific geographic location and use this information in a desired way.

The other information 124 includes event information/schedules for sporting and entertainment activities as may be made available online for access by the access component 102. There also can be previously embedded road sensors that can be accessed for traffic activity, traffic light sensors, and traffic cameras form which data can be accessed to include in the statistical computation. The embedded road sensors can conceivably give not only aggregate traffic information, but also can be used to track the likely path of a single vehicle when combined with other information described herein.

Included herein is a set of flow charts representative of exemplary methodologies for performing novel aspects of the disclosed architecture. While, for purposes of simplicity of explanation, the one or more methodologies shown herein, for example, in the form of a flow chart or flow diagram, are shown and described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events, such as in a state diagram. Moreover, not all acts illustrated in a methodology may be required for a novel implementation.

Figure 5:
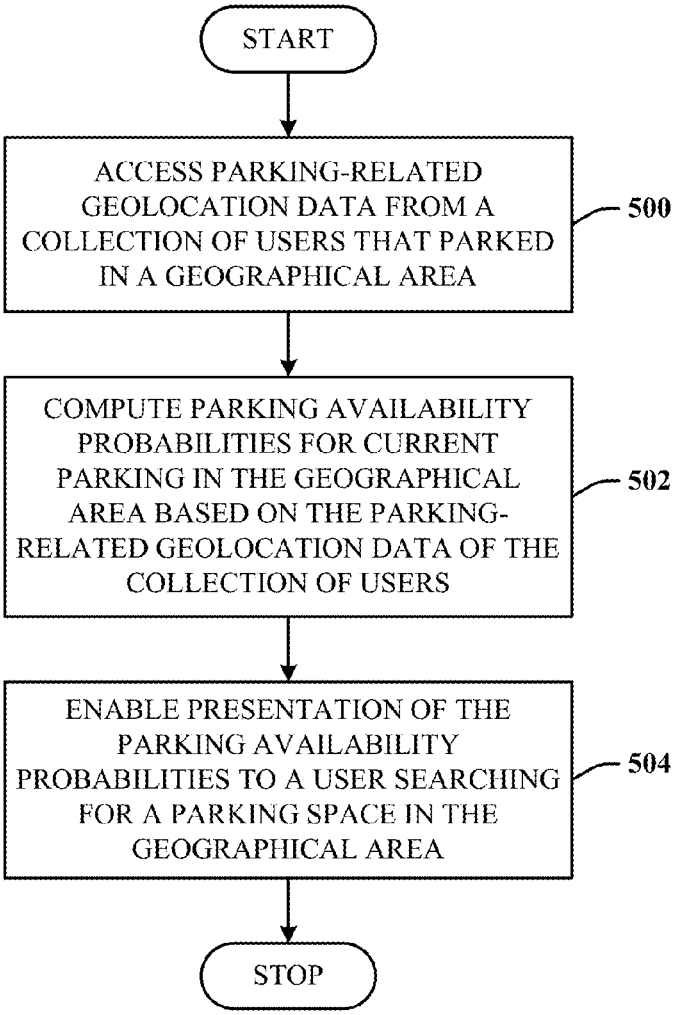
FIG. 5 illustrates a method in accordance with the disclosed architecture.

FIG. 5 illustrates a method in accordance with the disclosed architecture. At 500, parking-related geolocation data from a collection of users (e.g., undefined) that parked in a geographical area, is accessed. The user currently looking for the parking space can also be a member of this collection, in that geolocation data of the user captured in the past, as identified with looking for a parking space, is also capable of being mined and processed.

The parking-related geolocation data of a member of the collection of other users is a location trace and potentially other data that have been captured, analyzed, and processed to determine with a high degree of certainty that the member actually parked in the geographical area. Additionally, other data associated with that member parking can also be obtained and utilized as desired, such as the time of day, the parking was performed, the data of the week, if an event was occurring or about to occur, the weather conditions that time, road construction, rush hour, etc.

It is also the case the parking history of a specific user can be captured and analyzed to project where that user might currently want to park. Additionally, if there are numerous available parking spaces, this information can be made available to the user, based on user preferences, for example, so that the user can choose the general area or a specific parking space.

The geolocation data can be obtained directly from other users and/or indirectly from historical geolocation data captured from users. The geolocation data is related to a given geographical area in which a parking space is desired for a mode of transportation. The mode of transportation includes, but is not limited to, motorized modes such as cars, trucks, motorcycles, scooters, public transportation, and non-motorized modes such as bicycles, walking, trotting, running, roller-skating, skate-boards, and so on.

At 502, parking availability probabilities for current parking in the geographical area are computed based on the parking-related geolocation data of the collection of users. The "parking" can be defined to include parking areas (e.g., designated areas of multiple parking spaces, parking places along a street or route, etc.) and a single parking space.

At 504, the parking availability probabilities are enabled for presentation to a user searching for a parking space in the geographical area. That is, a first probability can be assigned for all potential parking in a first sub-area of the geographical area, a second probability can be assigned for all potential parking in a second sub-area of the geographical area, a third probability can be assigned for all potential parking in a third sub-area of the geographical area, and so on. In a very basic implementation, the user can be presented with a listing of identifiable information of the streets, intersections, parking facility (area) names, etc., and the associated probability values, in order to determined where to drive for a good chance of finding parking (e.g., a parking space).

The method can further comprise enabling presentation of a graphical view of the geographical area with the parking availability probabilities represented according to different graphical emphases as applied to areas in the graphical view. As designed into a graphical representation in a display of a user device, the graphical view can be a street-level map of buildings, landmarks, etc., where streets/avenues/routes that offer a high probability of available parking are provided with first graphical emphasis (e.g., a first color), streets/avenues/routes that offer a next lower probability of available parking are provided with a second graphical emphasis (e.g., a second color), and streets/avenues/routes that offer a still next lower probability of available parking are provided with a third graphical emphasis (e.g., a third color), and so on.

The method can further comprise classifying parking areas in the geographical area as public, semi-private, or private, based on the geolocation data of other users who have used the parking space. That is, if a given user parks in the same parking space over an extended period of time, there is a high likelihood that the user has an associated "right" or "entitlement" to that space over other users. It can be that the user simply gets to the space before most other users, and the related information (e.g., work starts a midnight) that confirms this, can be obtained and analyzed. This can further be validated if another user looking for a parking space, passes by the parking space when it is highly likely the space is unoccupied (or available), as detected from geolocation data (and maybe inertial data).

The method can further comprise inferring temporal information related to the parking based on the geolocation data. The temporal information can include time information for the parking activity for a given parking area at all times of the day, week, month, etc., and time restrictions (e.g., no parking during the day during 6 AM-6 PM). This restriction data can be obtained from websites that provide such information, from users that may provide such information as feedback via a user profile, user preferences, etc., for example. This time restriction information can be derived based on repeated use of the parking spaces by user over time. That is, if users who park in an area are detected as routinely leaving that parking area at a given time (e.g., other than end of day), it can be inferred that there is a time restriction for that parking area.

The method can further comprise inferring a maximum time allowed for the parking based on the geolocation data. The maximum time can be derived by analyzing the start time of the park activity and end time of the park activity over many parking users.

The method can further comprise accessing other information, other than the geolocation data, that affects parking in the geographical area, and computing the parking availability probabilities based on both the geolocation data and the other information. This other information includes, but is not limited to, weather data sources, road construction data sources, inertial sensor data (e.g., accelerometer, gyroscope, images, processed audio (e.g., traffic sounds, construction sounds, heavy equipment sounds), user input, social media message content, blog content, emails, event information, etc.).

The method can further comprise automatically detecting when the user is searching for the parking space based on geolocation data and inertial sensor data of the user. This detection can comprise not only geolocation tracing but also inertial sensor data such as from an accelerometer and/or a gyroscope, used on smart phones and computing devices. If the geolocation trace as analyzed indicates the user is repeatedly driving around one or more blocks ("driving in circles"), it can be inferred that the user is looking for parking. Moreover, if the user is "driving in circles" of ever-increasing radii, this can provide additional data that there is a high likelihood the user is looking for parking. If the user tends to repeat this activity daily or many times during the week, and at the location, this provides added data that may confirm the user is looking for parking.

Figure 6:
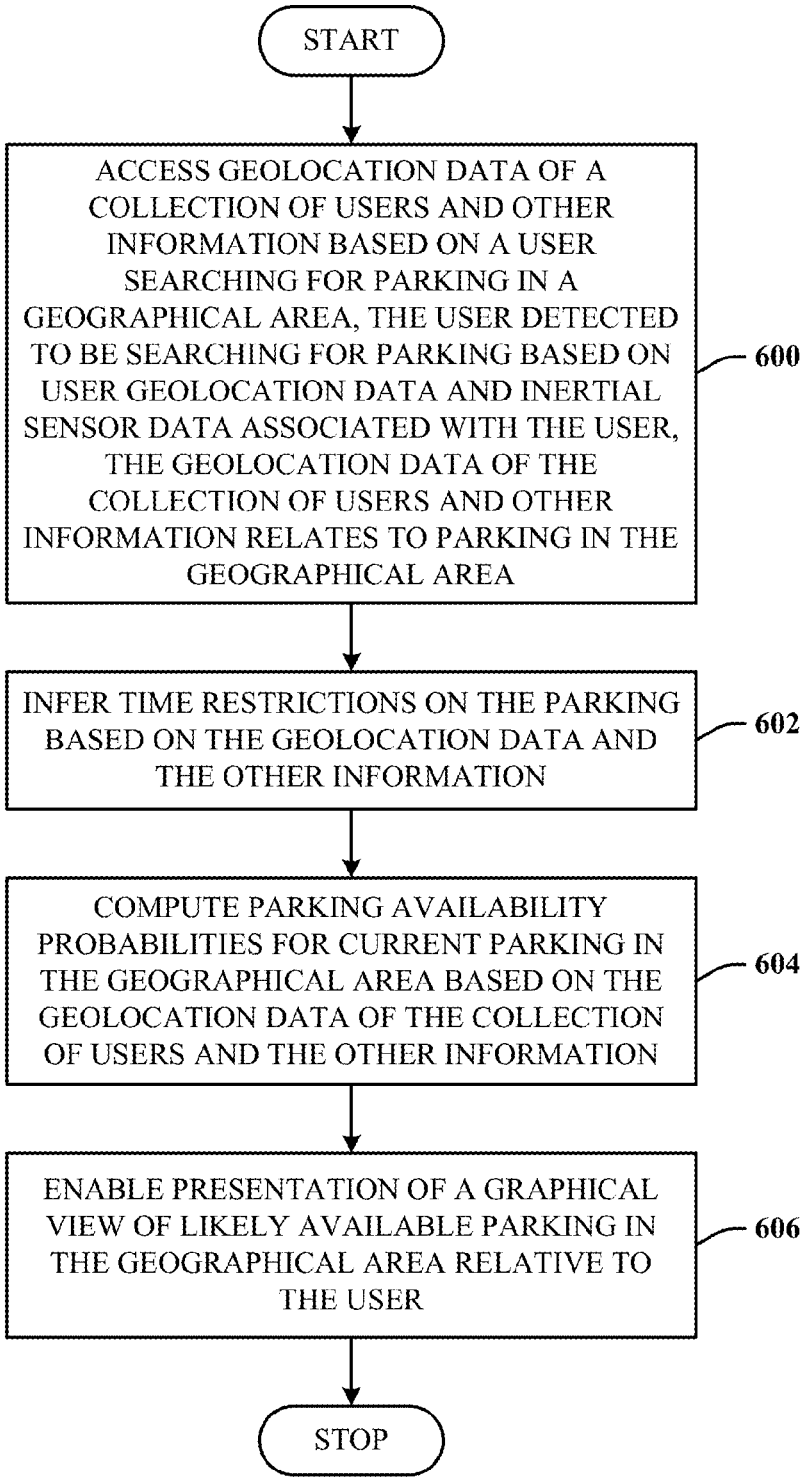
FIG. 6 illustrates an alternative method in accordance with the disclosed architecture.

FIG. 6 illustrates an alternative method in accordance with the disclosed architecture. It can be the case that the geolocation data (e.g., GPS) and inertial sensor data is obtained from a user device such as a smartphone; however, some or all of this data can be obtained using vehicle systems that include directional and motion sensors, and GPS systems.

At 600, geolocation data of a collection of users and other information is accessed based on a user searching for parking in a geographical area. The geolocation data of the collection of users and other information relates to parking of the collection of users in the geographical area. The other information includes, but is not limited to, weather conditions, road conditions due to weather, traffic, construction, event information as to entertainment, sporting events, concerts, etc., for example, that may occur or is occurring, user profile, user preferences, social media information, and so on. The user can be detected as searching for parking in the geographical area based on user geolocation data and inertial sensor data associated with the user. The GPS traces, for example, can indicate not only direction, but speed. Additionally, or separately, the inertia sensor data of an accelerometer and/or gyroscope can be used to detect directional information of the user as the user drives around. Thus, user/vehicle turns, stops, starts, and the like, can be identified and processed.

At 602, time restrictions on the parking can be inferred based on the geolocation data and the other information. The restrictions can be inferred by processing information of other user activity relative to parking in the area.

At 604, parking availability probabilities can be computed for current parking in the geographical area based on the geolocation data of the collection of users and the other information. For example, for three probability scores—low, medium, and high—a high probability value/score can be computed for parking that is available in the most distant region from the approximate center of the geographic area (e.g., downtown area), yet in the geographical area being considered; a medium probability value/score can be computed for parking that is in a region between the approximate center of the geographic area and the most distant region; and, a low probability value/score can be computed for parking that is in a region at the approximate center of the geographic area.

The above description is based on a simplistic circular area of multiple concentric regions. While this can be a model to use, streets and avenues are largely orthogonal or intersecting, and parking facilities are located along these streets and avenues. Thus, probabilities can be computed not only for streets and avenues, but individually for a parking place, parking lots, parking facilities, parking levels in the facilities, and parking spaces on the levels.

At 606, a graphical view (street map) of likely available parking in the geographical relative to the user is enabled for presentation. That is, the user location can be graphically presented on the view and, animated and tracked as the user travel to the geographical area and relative to the parking. The graphical view can be enabled for presentation on a user device (e.g., smartphone, portable computing device, etc.), on a vehicle device such as a vehicle display system, and/or a vehicle mounted route navigation system.

A microprocessor can be configured to execute instructions in a memory associated with at least one of the acts of accessing, inferring, computing, or enabling.

The method can further comprise sending a parking advisory to the user based on vicinity of the user to the geographical area. This advisory can be in the form of prompting the user to opt-in for the auto-presentation of available parking probabilities for a given area of interest. The parking advisory can be automatically triggered based on the geolocation information of the user, such as from a geo-fence, as configured in correlation to user preferences, for example. The parking advisory can be presented to the user as an audio message or tone(s) indicating as such.

In a more robust implementation, the disclosed architecture can be designed to operate in combination with an existing vehicle navigation system such that as the graphical view is initiated, it is initiated for presentation on the existing vehicle navigational device (e.g., vehicle navigation device display), and using the audio system of the vehicle navigation device. Thus, presentation includes not only the graphical view on the device display, but also audio instructions or comments about the parking as the user navigates the geographical area for the parking. The user can then maintain eye contact with driving, while the audio system provides instructions as to how to reach the parking areas of likely available parking.

The method can further comprise inferring the parking space is public, semi-private, or private, based on other users who have used the parking space. The method can further comprise suggesting a route relative to an intended destination that maximizes probability of finding parking while maintaining proximity of the user to the intended destination and avoiding an increase in time to reach the parking. In other words, it is not desired to increase the time to reaching the parking (and ultimately, the destination) based on the suggested route. However, this can be made configurable if the user is not in a hurry, the weather is pleasant, etc., and a specific predefined amount of extra time can be expended (e.g., no more than five extra minutes). The method can further comprise updating the graphical view of likely available parking as the user navigates relative to the geographical area.

The method can further comprise inferring availability of the parking based on a change in mode of transportation of the user. If the disclosed architecture detects that the user is driving in a vehicle, has stopped on the street, backs up into what is detected as a parking space and then stops, this is information that can be utilized to infer the user obtained a parking place. However, if the user gets out and starts walking, as detected by inertial data and speed information of the user device, this may indicate a change in the mode of transportation from driving to walking. This is further confirmation that the user found a parking place. This indicates the parking space is unavailable. In the reverse process, when the user returns to the vehicle, and drives away, the detected change in the mode of transportation indicates with some probability that the parking space is now available.

As used in this application, the terms "component" and "system" are intended to refer to a computer-related entity, either hardware, a combination of software and tangible hardware, software, or software in execution. For example, a component can be, but is not limited to, tangible components such as a processor, chip memory, mass storage devices (e.g., optical drives, solid state drives, and/or magnetic storage media drives), and computers, and software components such as a process running on a processor, an object, an executable, a data structure (stored in a volatile or a non-volatile storage medium), a module, a thread of execution, and/or a program.

By way of illustration, both an application running on a server and the server can be a component. One or more components can reside within a process and/or thread of execution, and a component can be localized on one computer and/or distributed between two or more computers. The word "exemplary" may be used herein to mean serving as an example, instance, or illustration. Any aspect or design described herein as "exemplary" is not necessarily to be construed as preferred or advantageous over other aspects or designs.

Figure 7:
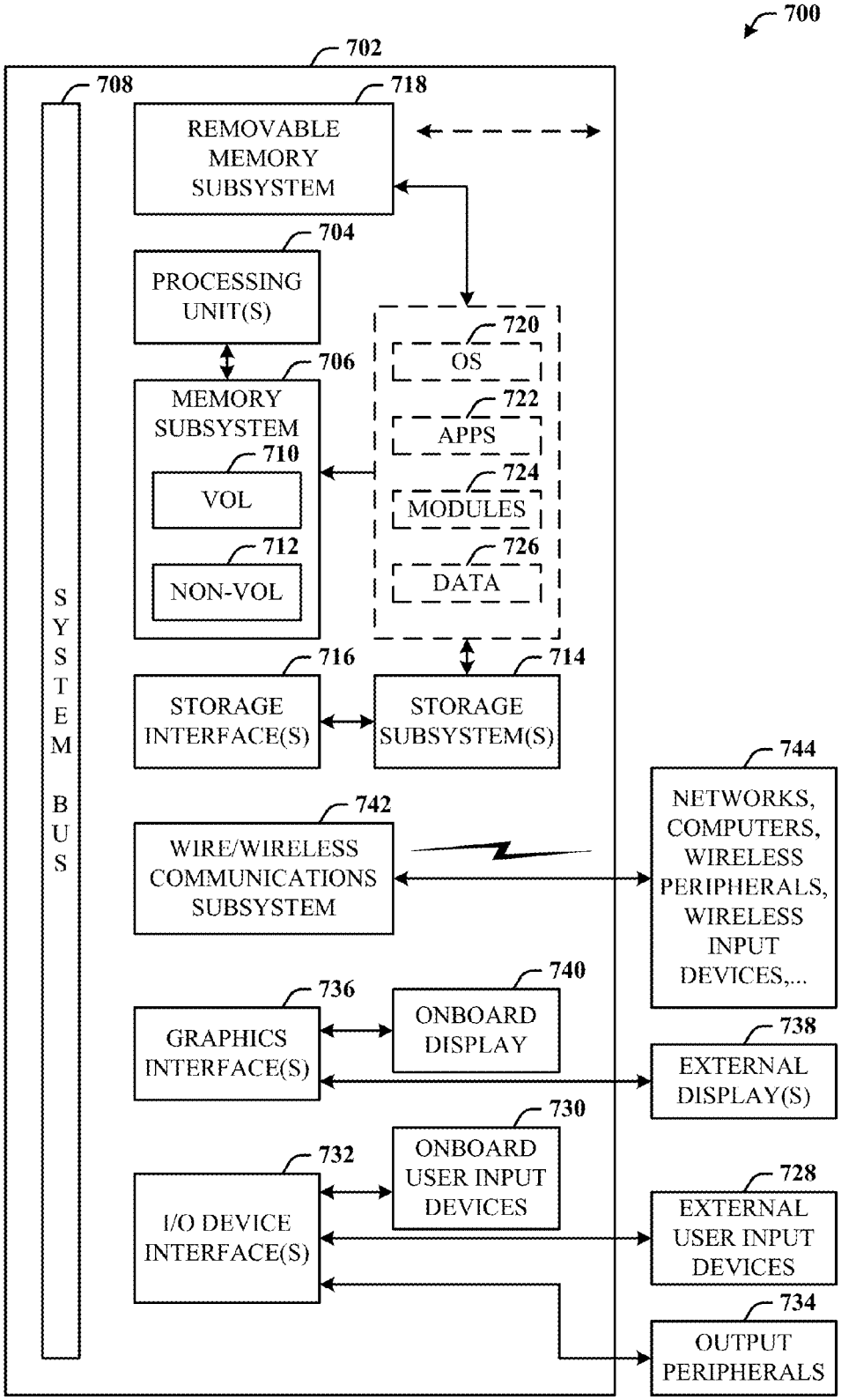
FIG. 7 illustrates a block diagram of a computing system that executes crowd-sourced advisory in accordance with the disclosed architecture.

Referring now to FIG. 7, there is illustrated a block diagram of a computing system 700 that executes crowd-sourced advisory in accordance with the disclosed architecture. However, it is appreciated that the some or all aspects of the disclosed methods and/or systems can be implemented as a system-on-a-chip, where analog, digital, mixed signals, and other functions are fabricated on a single chip substrate.

In order to provide additional context for various aspects thereof, FIG. 7 and the following description are intended to provide a brief, general description of the suitable computing system 700 in which the various aspects can be implemented. While the description above is in the general context of computer-executable instructions that can run on one or more computers, those skilled in the art will recognize that a novel embodiment also can be implemented in combination with other program modules and/or as a combination of hardware and software.

The computing system 700 for implementing various aspects includes the computer 702 having processing unit(s) 704 (also referred to as microprocessor(s) and processor(s)), a computer-readable storage medium such as a system memory 706 (computer readable storage medium/media also include magnetic disks, optical disks, solid state drives, external memory systems, and flash memory drives), and a system bus 708. The processing unit(s) 704 can be any of various commercially available processors such as single-processor, multi-processor, single-core units and multi-core units. Moreover, those skilled in the art will appreciate that the novel methods can be practiced with other computer system configurations, including minicomputers, mainframe computers, as well as personal computers (e.g., desktop, laptop, tablet PC, etc.), hand-held computing devices, microprocessor-based or programmable consumer electronics, and the like, each of which can be operatively coupled to one or more associated devices.

The computer 702 can be one of several computers employed in a datacenter and/or computing resources (hardware and/or software) in support of cloud computing services for portable and/or mobile computing systems such as cellular telephones and other mobile-capable devices. Cloud computing services, include, but are not limited to, infrastructure as a service, platform as a service, software as a service, storage as a service, desktop as a service, data as a service, security as a service, and APIs (application program interfaces) as a service, for example.

The system memory 706 can include computer-readable storage (physical storage) medium such as a volatile (VOL) memory 710 (e.g., random access memory (RAM)) and a non-volatile memory (NON-VOL) 712 (e.g., ROM, EPROM, EEPROM, etc.). A basic input/output system (BIOS) can be stored in the non-volatile memory 712, and includes the basic routines that facilitate the communication of data and signals between components within the computer 702, such as during startup. The volatile memory 710 can also include a high-speed RAM such as static RAM for caching data.

The system bus 708 provides an interface for system components including, but not limited to, the system memory 706 to the processing unit(s) 704. The system bus 708 can be any of several types of bus structure that can further interconnect to a memory bus (with or without a memory controller), and a peripheral bus (e.g., PCI, PCIe, AGP, LPC, etc.), using any of a variety of commercially available bus architectures.

The computer 702 further includes machine readable storage subsystem(s) 714 and storage interface(s) 716 for interfacing the storage subsystem(s) 714 to the system bus 708 and other desired computer components. The storage subsystem (s) 714 (physical storage media) can include one or more of a hard disk drive (HDD), a magnetic floppy disk drive (FDD), solid state drive (SSD), and/or optical disk storage drive (e.g., a CD-ROM drive DVD drive), for example. The storage interface(s) 716 can include interface technologies such as EIDE, ATA, SATA, and IEEE 1394, for example.

One or more programs and data can be stored in the memory subsystem 706, a machine readable and removable memory subsystem 718 (e.g., flash drive form factor technology), and/or the storage subsystem(s) 714 (e.g., optical, magnetic, solid state), including an operating system 720, one or more application programs 722, other program modules 724, and program data 726.

The operating system 720, one or more application programs 722, other program modules 724, and/or program data 726 can include entities and components of the system 100 of FIG. 1, entities and components of the system 200 of FIG. 2, entities and component so the layout 300 of FIG. 3, entities and components of the graphical view 400 of FIG. 4, and the methods represented by the flowcharts of FIGS. 5 and 6, for example.

Generally, programs include routines, methods, data structures, other software components, etc., that perform particular tasks or implement particular abstract data types. All or portions of the operating system 720, applications 722, modules 724, and/or data 726 can also be cached in memory such as the volatile memory 710, for example. It is to be appreciated that the disclosed architecture can be implemented with various commercially available operating systems or combinations of operating systems (e.g., as virtual machines).

The storage subsystem(s) 714 and memory subsystems (706 and 718) serve as computer readable media for volatile and non-volatile storage of data, data structures, computer-executable instructions, and so forth. Such instructions, when executed by a computer or other machine, can cause the computer or other machine to perform one or more acts of a method. The instructions to perform the acts can be stored on one medium, or could be stored across multiple media, so that the instructions appear collectively on the one or more computer-readable storage medium/media, regardless of whether all of the instructions are on the same media.

Computer readable storage media (medium) can be any available media (medium) that do (does) not employ propagated signals, can be accessed by the computer 702, and includes volatile and non-volatile internal and/or external media that is removable and/or non-removable. For the computer 702, the various types of storage media accommodate the storage of data in any suitable digital format. It should be appreciated by those skilled in the art that other types of computer readable medium can be employed such as zip drives, solid state drives, magnetic tape, flash memory cards, flash drives, cartridges, and the like, for storing computer executable instructions for performing the novel methods (acts) of the disclosed architecture.

A user can interact with the computer 702, programs, and data using external user input devices 728 such as a keyboard and a mouse, as well as by voice commands facilitated by speech recognition. Other external user input devices 728 can include a microphone, an IR (infrared) remote control, a joystick, a game pad, camera recognition systems, a stylus pen, touch screen, gesture systems (e.g., eye movement, head movement, etc.), and/or the like. The user can interact with the computer 702, programs, and data using onboard user input devices 730 such a touchpad, microphone, keyboard, etc., where the computer 702 is a portable computer, for example.

These and other input devices are connected to the processing unit(s) 704 through input/output (I/O) device interface(s) 732 via the system bus 708, but can be connected by other interfaces such as a parallel port, IEEE 1394 serial port, a game port, a USB port, an IR interface, short-range wireless (e.g., Bluetooth) and other personal area network (PAN) technologies, etc. The I/O device interface(s) 732 also facilitate the use of output peripherals 734 such as printers, audio devices, camera devices, and so on, such as a sound card and/or onboard audio processing capability.

One or more graphics interface(s) 736 (also commonly referred to as a graphics processing unit (GPU)) provide graphics and video signals between the computer 702 and external display(s) 738 (e.g., LCD, plasma) and/or onboard displays 740 (e.g., for portable computer). The graphics interface(s) 736 can also be manufactured as part of the computer system board.

The computer 702 can operate in a networked environment (e.g., IP-based) using logical connections via a wired/wireless communications subsystem 742 to one or more networks and/or other computers. The other computers can include workstations, servers, routers, personal computers, microprocessor-based entertainment appliances, peer devices or other common network nodes, and typically include many or all of the elements described relative to the computer 702. The logical connections can include wired/wireless connectivity to a local area network (LAN), a wide area network (WAN), hotspot, and so on. LAN and WAN networking environments are commonplace in offices and companies and facilitate enterprise-wide computer networks, such as intranets, all of which may connect to a global communications network such as the Internet.

When used in a networking environment the computer 702 connects to the network via a wired/wireless communication subsystem 742 (e.g., a network interface adapter, onboard transceiver subsystem, etc.) to communicate with wired/wireless networks, wired/wireless printers, wired/wireless input devices 744, and so on. The computer 702 can include a modem or other means for establishing communications over the network. In a networked environment, programs and data relative to the computer 702 can be stored in the remote memory/storage device, as is associated with a distributed system. It will be appreciated that the network connections shown are exemplary and other means of establishing a communications link between the computers can be used.

The computer 702 is operable to communicate with wired/wireless devices or entities using the radio technologies such as the IEEE 802.xx family of standards, such as wireless devices operatively disposed in wireless communication (e.g., IEEE 802.11 over-the-air modulation techniques) with, for example, a printer, scanner, desktop and/or portable computer, personal digital assistant (PDA), communications satellite, any piece of equipment or location associated with a wirelessly detectable tag (e.g., a kiosk, news stand, restroom), and telephone. This includes at least Wi-Fi™ (used to certify the interoperability of wireless computer networking devices) for hotspots, WiMax, and Bluetooth™ wireless technologies. Thus, the communications can be a predefined structure as with a conventional network or simply an ad hoc communication between at least two devices. Wi-Fi networks use radio technologies called IEEE 802.11x (a, b, g, etc.) to provide secure, reliable, fast wireless connectivity. A Wi-Fi network can be used to connect computers to each other, to the Internet, and to wire networks (which use IEEE 802.3-related technology and functions).

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system, comprising:

an access component configured to access parking-related geolocation data of a collection of users that have parked or searched for parking in a geographical area;

a statistical computation component configured to compute parking availability probabilities for parking in the geographical area based on the parking-related geolocation data of the collection of users;

a presentation component configured to present the parking availability probabilities to a user searching for a parking space in the geographical area; and a microprocessor configured to execute computer-executable instructions associated with at least one of the access component, statistical computation component, or the presentation component.

2. The system of claim 1, further comprising an inferencing algorithm configured to infer time-related restrictions on the parking space based on the parking-related geolocation data of the collection of users and other sources of information.

3. The system of claim 1, further comprising a detection algorithm configured to automatically detect the user is searching for the parking space in the geographical area based on geolocation data and inertial data of the user.

4. The system of claim 1, wherein the statistical computation component classifies the parking in the geographical area according to degrees of public and private access.

5. The system of claim 1, wherein the presentation component is configured to present the parking availability probabilities in a graphical view as different corresponding colors on a street map of the geographical area, and to automatically update the parking availability probabilities in the graphical view as the user searches for the parking space.

6. The system of claim 1, wherein the statistical computation component is configured to compute the parking availability probabilities for parking in the geographical area based on the parking-related geolocation data of a collection of users and a time during which the user is searching for the parking space.

7. The system of claim 1, wherein the presentation component is configured to apply graphical emphasis to a graphical view of a street map of the geographical area, the graphical emphasis applied to parking along streets and avenues of the map, and in various colors associated with differing parking availability probabilities of the parking along the streets and avenues.

8. The system of claim 1, further comprising an advisory component configured to send an advisory to the user via the presentation component, the advisory notifies the user of the parking availability in the geographical area according to the parking availability probabilities.

9. A method performed by a computer system executing machine-readable instructions, the method comprising acts of:

accessing parking-related geolocation data from a collection of users that parked in a geographical area;

computing parking availability probabilities for current parking in the geographical area based on the parking-related geolocation data of the collection of users;

enabling presentation of the parking availability probabilities to a user searching for a parking space in the geographical area; and configuring a microprocessor to execute instructions in a memory, the instructions associated with at least one of the acts of accessing, computing, or enabling.

10. The method of claim 9, further comprising classifying parking areas in the geographical area as public, semi-private, or private, based on the geolocation data of other users who have used the parking space.

11. The method of claim 9, further comprising inferring temporal information related to the parking based on the geolocation data.

12. The method of claim 9, further comprising inferring a maximum time allowed for the parking based on the geolocation data.

13. The method of claim 9, further comprising accessing other information, other than the geolocation data, that affects parking in the geographical area, and computing the parking availability probabilities based on both the geolocation data and the other information.

14. The method of claim 9, further comprising automatically detecting the user is searching for the parking space based on geolocation data and inertial sensor data of the user.

15. The method of claim 9, further comprising enabling presentation of a graphical view of the geographical area with the parking availability probabilities represented according to different graphical emphases as applied to areas in the graphical view.

16. A method performed by a computer system executing machine-readable instructions, the method comprising acts of:

accessing geolocation data of a collection of users and other information based on a user searching for parking in a geographical area, the user detected to be searching for parking based on user geolocation data and inertial sensor data associated with the user, the geolocation data of the collection of users and other information relates to parking in the geographical area;

inferring time restrictions on the parking based on the geolocation data of the collection of users and the other information;

computing parking availability probabilities for current parking in the geographical area based on the geolocation data of the collection of users and the other information;

enabling presentation of a graphical view of likely available parking in the geographical area relative to the user; and configuring a microprocessor to execute instructions in a memory, the instructions associated with at least one of the acts of accessing, inferring, computing, or enabling.

17. The method of claim 16, further comprising sending a parking advisory to the user based on vicinity of the user to the geographical area.

18. The method of claim 16, further comprising suggesting a route relative to an intended destination that maximizes probability of finding parking while maintaining proximity of the user to the intended destination and avoiding an increase in time to reach the parking.

19. The method of claim 16, further comprising updating the graphical view of likely available parking as the user navigates relative to the geographical area.

20. The method of claim 16, further comprising inferring availability of the parking based on a change in mode of transportation of the user.

* * * * *